United States Patent [19]

Tuvesson

[11] Patent Number: 4,591,127

[45] Date of Patent: May 27, 1986

[54] SUSPENSION ATTACHMENT

[76] Inventor: Pär-Åke Tuvesson, Lövängsvägen 4, 262 00 Ängelholm, Sweden

[21] Appl. No.: 653,088

[22] Filed: Sep. 21, 1984

[30] Foreign Application Priority Data

Apr. 9, 1984 [SE] Sweden ..... 8401956

[51] Int. Cl.[4] ..... E05B 73/00

[52] U.S. Cl. ..... 248/551; 248/230; 70/18; 211/4

[58] Field of Search ..... 248/551, 552, 230, 225.31, 248/228, 553; 211/4, 5; 70/18

[56] References Cited

U.S. PATENT DOCUMENTS

| | | | |
|---|---|---|---|
| 2,639,604 | 5/1953 | Wardius | 248/552 X |
| 3,772,645 | 11/1973 | Odenz | 70/18 X |
| 4,057,983 | 11/1977 | Morgan | 70/18 |
| 4,194,459 | 3/1980 | Lisowski | 248/230 X |

FOREIGN PATENT DOCUMENTS

| | | | |
|---|---|---|---|
| 107769 | of 1900 | Fed. Rep. of Germany | 211/4 |
| 2556352 | 6/1977 | Fed. Rep. of Germany | 70/18 |
| 2334387 | 7/1977 | France | 70/18 |

*Primary Examiner*—Ramon S. Britts

*Assistant Examiner*—Karen J. Chotkowski

*Attorney, Agent, or Firm*—Schwartz, Jeffery, Schwaab, Mack, Blumenthal & Evans

[57] ABSTRACT

The present invention refers to a suspension attachment for suspending objects (2 and/or 31) on elongated units (3), preferably for suspending boat accessories on pulpit tubes on boats. Such a suspension attachment, which is simple and sturdy and permits a safe holding of various types of objects and also can lock them against unauthorized removal when desired, is characterized in that it comprises a holder (4) from which two parts (9,10) can be placed in such a manner on the elongated unit (3) that said unit extends between them, that the two parts (9,10) may be clamped to each other by means of locking elements (11 and/or 12) to secure the holder (4) to the elongated unit (3), that the holder (4) has one or several support surfaces (19 and/or 20 and/or 21) to permit suspension of one or several objects (2 and/or 31), preferably boat accessories or suspension means (31) for boat accessories, and that the suspendable object (2 and/or 31) is locked to the holder (49) by means of one or several locking units and/or locking elements (22 and/or 34 and/or 38,39) (FIGS. 1 and 4).

15 Claims, 7 Drawing Figures

SUSPENSION ATTACHMENT

BACKGROUND OF THE INVENTION

1. Field of the Invention

The present invention refers to a suspension attachment for suspending objects to elongated units preferably for suspending boat accessories to pulpit tubes of boats.

2. Background Art

Suspension attachments for suspending various objects for example boat accessories to elongated units such as pulpit tubes of boats need to be simple and sturdy, should permit suspension of various kinds of objects, be able to securely hold the objects when travelling in high sea and should permit locking of the objects to prevent unauthorized removal in case the objects are valuable.

SUMMARY OF THE INVENTION

The object of the invention has been to provide a suspension attachment which is simple and sturdy, which provides safe suspension of various types of objects and also provides a locking for preventing their removal.

DETAILED DESCRIPTION OF THE INVENTION

Figure 3:
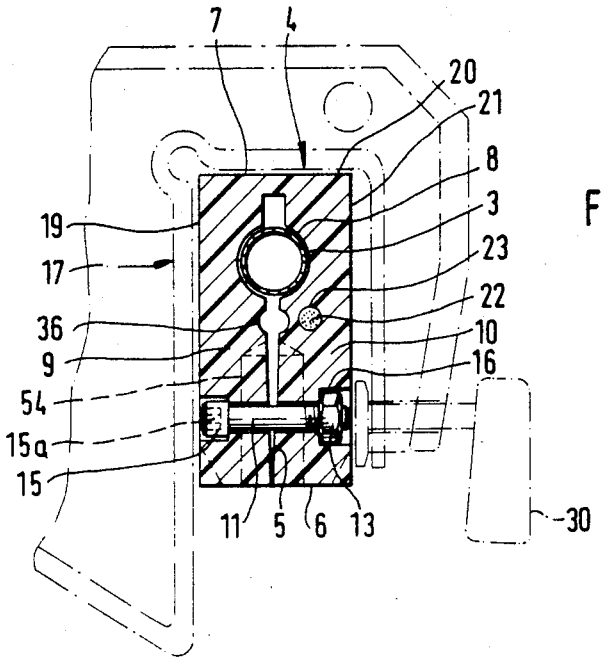
FIG. 3 illustrates a section through the suspension attachment according to FIGS. 1 and 2.

The suspension attachment illustrated in the drawings is specifically intended for suspension and locking of objects such as boat accessories to elongated units in the shape of stern pulpit tubes 3 on boats, for example sailing boats. Referring to FIG. 3, the suspension attachment 1 comprises a holder in the shape of a block 4 from plastic material, which has a slot 5 which extends from one edge 6 of the block 4 towards the opposite edge 7 thereof and ends somewhat inside this edge 7. The slot 5 widens into a hole 8 for receiving the stern pulpit tube 3 and the hole passes through the block 4. The hole 8 is closer to edge 7 than edge 6. The elastic properties of the plastic material makes it possible to open the block 4 by bending apart the parts 9, 10 thereof such that the block 4 may be brought over the stern pulpit tube 3 for instance from above until it extends through the hole 8.

Figure 2:
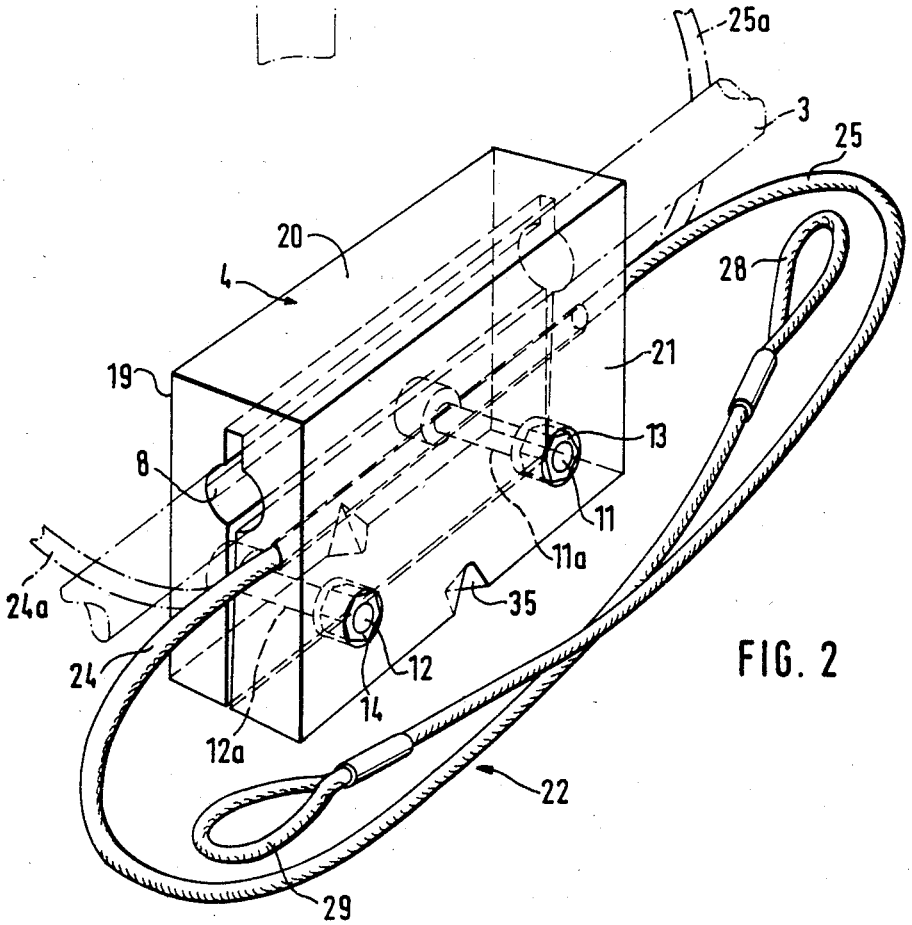
FIG. 2 illustrates the suspension attachment of FIG. 1 on a larger scale.

Referring to FIG. 2, the block 4 is locked to the stern pulpit tube 3 by means of locking elements such as two screws 11, 12 and corresponding nuts 13, 14. The screws 11, 12 are provided in through holes 11*a*, 12*a* adjacent to the edge 6 such that they will be located at a relatively large distance from the pulpit tube 3. The diameter of the hole 8 in an unexpanded state is preferably smaller than the outer diameter of the pulpit tube 3. Thus, the parts 9, 10 of the block 4 will be clamped to the pulpit tube with a rather large force when the screw joints 11, 13 and 12, 14 are tightened. The larger the distance between the pulpit tube 3 and the screw joints 11, 13 and 12, 14 is the larger this clamping force will be.

As shown in FIG. 3, the heads 15 of the screws 11, 12 are provided with internal key handles 15*a* and the nuts 13, 14 are located in suitable recesses 16 in the block 4, said recesses being only a little bit wider than the nuts 13, 14, which makes it impossible to reach them to turn them by means of a tool. The screws 11, 12 are further so located that it is not possible to reach the screw heads 15 since the latter are hidden behind carrying yokes 17, 18 at the outboard motor 2. This means that it is not possible to reach the key handles 15*a* and this in addition to the location of the nuts 13, 14 in narrow recesses 16 ensures that the screw joints 11, 13 and 12, 14 cannot be unfastened when the outboard motor 2 is suspended upon the support surfaces 19, 20, 21 of the block 4. In the illustrated outboard motor 2 the carrying yokes 17, 18 are further extended so deep behind the block 4 that they cover the nuts 13, 14.

Figure 1:
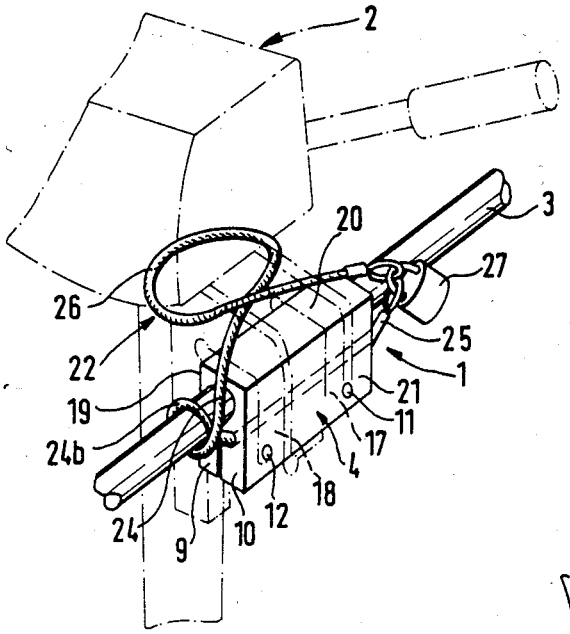
FIG. 1 is a perspective view of a suspension attachment according to the invention.

The outboard motor 2 is locked in this position to the block 4 by means of a wire 22 as shown in FIG. 1. The wire extends through a hole 23 in the block 4 and the parts 24, 25 thereof which extend in opposite directions from the block 4 form two locking means, which can be tied around the outboard motor 2 such that they together form a loop 26 around the motor. In order to lock this loop 26 the locking means 24, 25 can be locked to each other when the locking yoke of a padlock 27 is threaded through end loops 28, 29 of locking means 24, 25.

It is advisable that this loop 26 also passes around the stern pulpit tube 3. To accomplish this, the part 24 of the wire is pulled beyond the rear pulpit tube 3 on one side thereof (see the position 24*a* of the wire part 24 illustrated in dash and dot lines in FIG. 2), while the part 25 of the wire 22 is pulled beyond the stern pulpit tube 3 on the other side of the latter (see the position 25*a* of the part 25 of the wire 22 illustrated in dash and dot lines in FIG. 2).

One of the parts 24 or 25 of the wire 22 or both parts 24, 25 can be laid in loops around the stern pulpit tube 3 (FIG. 1 illustrates how the part 24 of the wire is laid in a loop 24*b* around the stern pulpit tube 3). The wire 22 can of course also be arranged differently than the illustrated embodiments. The arrangement of the wire 22 will depend upon the length of the wire, upon the object to be secured, and upon the way in which the padlock 27 or the like is applied.

Figure 4:
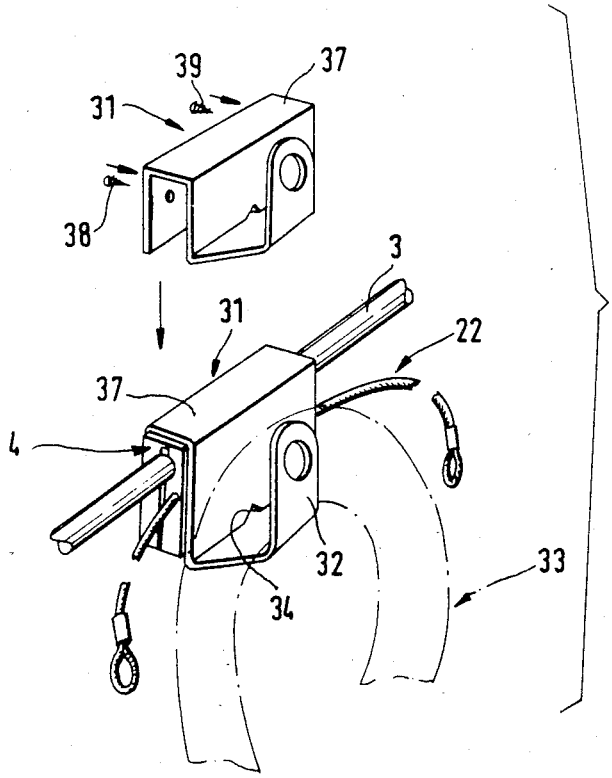
FIG. 4 is a perspective view of a suspension attachment according to the invention provided with a special suspension means.

As shown in FIG. 1, the outboard motor 2 is suspended in block 4 by bringing the carrying yokes 17, 18 thereof over the holder 4 and letting it go downwards as long as possible. The carrying yokes 17, 18 are secured to the block 4 by means of the tightening screws 30 as shown in FIG. 3. Then locking is carried out by means of the wire 22. If it is instead desired to suspend objects without use of carrying yokes and the like, which fit the block 4, the latter can be provided, as shown in FIG. 4, using a suspension means 31. The U-shaped part 37 of the suspension means 31 is threaded down over the block 4 until it contacts the support surfaces 19, 20, 21 of the block 4.

The suspension means 31 is provided with an upwardly extending suspension part 32, in which different kinds 33 of objects can be suspended, whereupon they might be locked by means of the wire 22. The suspension means 31 can be made from a resilient material and be so dimensioned that it remains on the block 4 by clamping action. To ensure that the suspension means 31 is securedly fixed to the block 4, the suspension means may have a projecting locking portion 34, which engages a corresponding recess 35 in the block 4 when the suspension means 31 is threaded down over the same. The suspension means 31 further can be secured to the block 4 by means of a number of screws 38, 39.

The suspension attachment now described and illustrated in the drawings may be varied within the scope of the following claims. As an alternative, it may be mentioned that the holder 4 can consist of two separate parts, which are clamped against the tube 3 instead of a unit in the shape of a block. The holder 4 can have one, two, three or another number of support surfaces for suspending objects 2 and/or 31. The holder 4 can be secured to the tube 3 by means of one, two, or three or any other number of locking elements 11, 12 or in some other manner. If the locking element consists of screws 11, 12 the latter can be shaped and located in another manner than described, for example above as well as below the pulpit tube 3. If a block is used as holder 4, it can be made from another material than plastic, and if it comprises two parts 9, 10 pivotally with respect to each other, these parts can alternatively be connected to each other by means of separate hinge-like means. The locking means 22 can consist of a part which can be laid in a loop around the object 2 and can be locked to the holder 4 or a part which extends through the holder 4 in accordance with the illustrated embodiment. Likewise, the locking means may comprise two separate parts which extend from two opposite sides of the holder or it can consist of another number of parts. The locking means 22 can consist of a chain or some other suitable means other than a wire, and it can be locked in another way than by means of padlock. One or several objects 2,31 can be suspended directly from the holder 4 and if the object is in the shape of suspension means 31, the latter can be of different types depending upon what kind of objects are to be carried. The holder can be secured to other types of elongated elements than rear pulpit tubes on boats and other kinds of objects, preferably boat accessories can be suspended and if necessary locked by means of the locking device. The holder 4 can also have a transverse, blind hole 60, which permits the holder being pushed over the end of a preferably upwardly directed bar (not shown). Instead of extending through a hole 23 in the holder 4, the wire 22 or the corresponding locking unit can be located between the parts 9, 10 of the holder 4 so that the wire 22 or the corresponding locking unit need not be integral with the holder 4 but is removable therefrom. The parts 9, 10 can have recesses 36 to receive the wire 22 or the corresponding locking unit such that the latter does not impede the securing of the holder 4. Locking of the suspension means 31 to the holder 4 can be achieved by means of friction engagement between said parts and/or by snapping the suspension means 31 to the holder 4.

Figure 5:
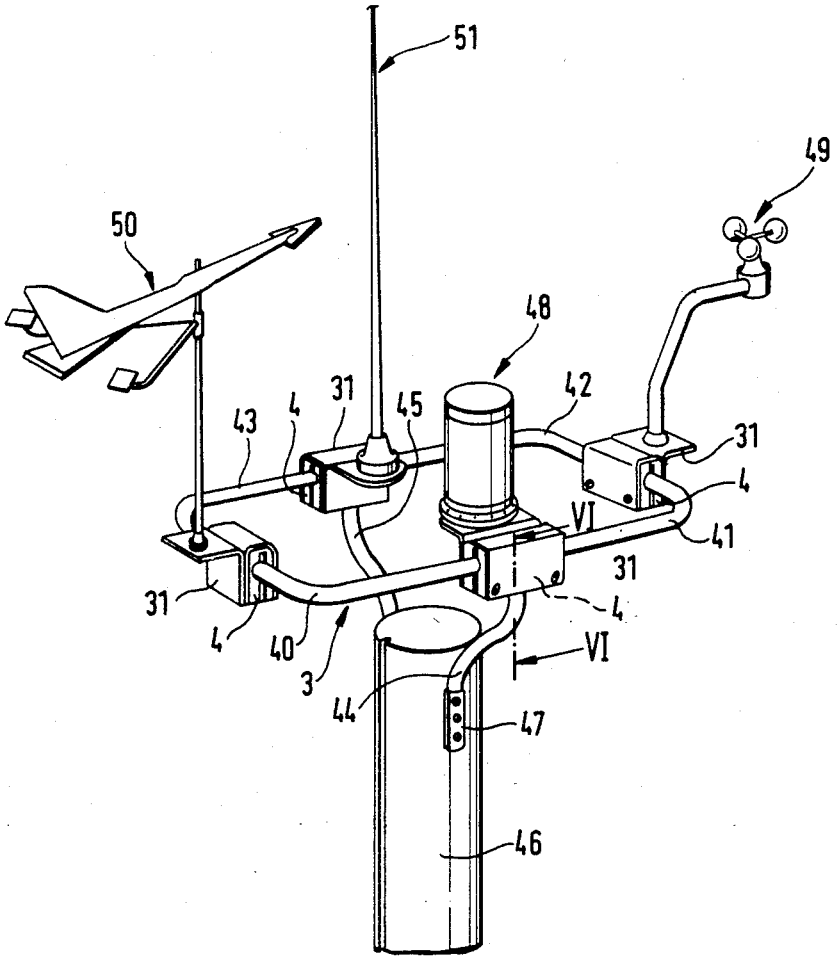
FIG. 5 is a perspective view of a suspension attachment according to the invention at a mast top arrangement.

In FIG. 5 a mast top arrangement is illustrated where four holders 4 are used as joints capable of being tightened so as to permit elongated elements 3 in the shape of four uniform frame pieces 40–43 to be secured to the holders 4 and in relation to each other by tightening of locking elements 11 and 12. In this case, there are two pairs of locking elements 11 and 12, i.e. one pair provided at one side of the hole 8 and the other pair at the other side thereof. Two of the holders are pushed upon anchoring means 44 and 45 from above and secured to the latter by tightening the locking elements 11 and 12. Between the anchoring means 44 and 45, the closed frame (comprised of the frame pieces 40–43) is secured to a mast 46 of a ship, for instance by means of screw joints 47 or the like. The holders are provided suspension means 31 for various boat accessories, such as a position light 48, a wind anemometer 49, a wind direction indicator 50, and an antenna 51 which is intended to be secured to the mast top. The frame pieces 40–43 preferably consists of uniform corner pieces and the anchoring members 44, 45 are also preferably uniform.

Figure 6:
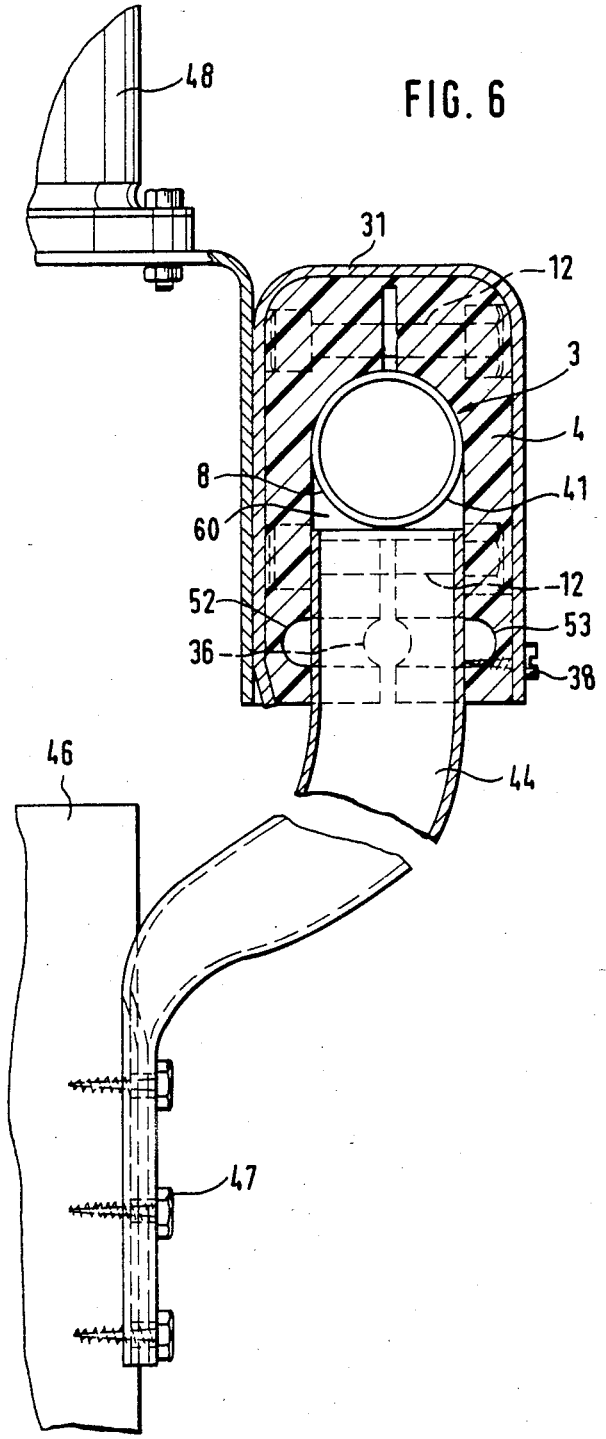
FIG. 6 illustrates a section VI—VI through the suspension attachment according to FIG. 5.
Figure 7:
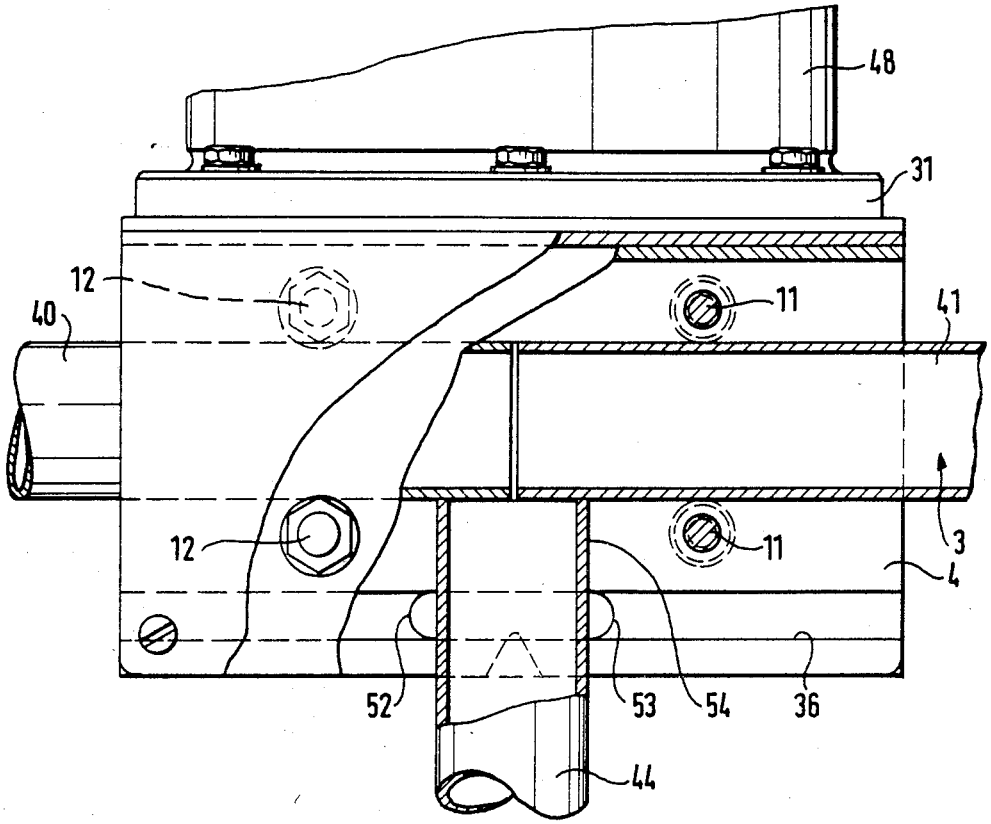
FIG. 7 is a sectional side view of the suspension attachment according to FIG. 5.

As shown in FIG. 6, the hole 60 of the holder 4 has recesses 52, 53. These recesses allow an object to be passed along wire 22 upon which the holder 4 is threaded. Also, the wire 22 can be used to lock an object to the holder 4.

I claim:

1. A suspension attachment for suspending accessories on elongated objects, comprising:

(a) a holder means having (1) a first hole extending therethrough for receiving an elongated support, said first hole extending substantially parallel to a first and second side of said holder means, said first hole being disposed closer to said first side than said second side;

(2) a second hole extending therethrough, said second hole extending substantially perpendicular to said first hole, said second hole being disposed between said first hole and said second side;

(3) a slot extending substantially perpendicular to an axis of said first hole, said slot extending from said second side to a point between said first hole and said first side;

(b) a generally U-shaped yoke adapted to removably fit over said holder means;

(c) means disposed on said yoke for receiving an accessory; and (d) clamping means adapted to engage with said second hole for clamping said holder onto the elongated support.

2. The attachment of claim 1, wherein said clamping means is a bolt and nut unit.

3. The attachment of claim 2, wherein said holder comprises a plurality of second holes.

4. An attachment as claimed in claim 1, further comprising a third hole, said third hole extending substantially parallel to said first hole, wherein an elongated flexible member is disposed through said third hole, said member adapted to be placed around a boat accessory to prevent, by interlocking ends of said member, removal of said boat accessory from said holder means.

5. An attachment as claimed in claim 4, wherein said elongated member is a wire.

6. An attachment as claimed in claim 1, comprising means defining at least one recess in said holder means for locking an object.

7. A mast top arrangement comprising a closed frame and a plurality of holder means disposed on said frame, each of said holder means comprising:

(a) a first channel extending through said holder means for accommodating a portion of said frame, and a second channel extending through said holder means, said second channel being perpendicular to said first channel, (b) an elongated anchoring means, wherein a first end of said anchoring means is received in said second channel;

(c) a mast attachment coupled to a first end of said anchoring means for attachment to a mast, (d) clamping means extending through said second channel for clamping said holder means securely against said frame, (e) a generally U-shaped accessory attachment adapted to removably fit over each of said holder means and to be anchored thereto; and (f) means on said accessory attachment for receiving an accessory thereon.

8. A mast top arrangement as claimed in claim 7, wherein said closed frame comprises four tubular bent parts and four holders adapted to receive said tubular bent parts in said first channels of said holders.

9. A mast top arrangement as claimed in claim 8, wherein said elongated anchoring means extends along said second channel, and wherein said frame parts extend into said first channel so as to abut said elongated anchoring means.

10. A mast top arrangement as claimed in claim 7, wherein said accessory attachment includes holes therethrough and wherein said clamping means extend through said holes to secure said accessory attachment to said holder means.

11. A mast top arrangement as claimed in claim 10, wherein said accessory receiving means on said accessory attachment comprises a projecting bracket which is horizontal in the position of use and is adapted to accomodate the accessory.

12. The attachment of claim 1 further comprising a third hole for receiving an elongated support, said third hole being substantially perpendicular to said first hole and extending from said second side to said first hole.

13. The attachment of claim 2 further comprising a third hole for receiving an elongated support, said third hole being substantially perpendicular to said first hole and extending from said second side to said first hole.

14. The attachment of claim 3 further comprising a third hole for receiving an elongated support, said third hole being substantially perpendicular to said first hole and extending from said second side to said first hole.

15. The attachment of claim 4 further comprising a fourth hole for receiving an elongated support, said fourth hole being substantially perpendicular to said first hole and extending from said second side to said first hole.

* * * * *